United States Patent [19]

Inoue et al.

[11] 4,072,415

[45] Feb. 7, 1978

[54] APPARATUS OF GENERATING CONTROL SIGNALS FOR CONTROLLING AN OPERATION OF AN ELECTROPHOTOGRAPHIC COPYING MACHINE

[75] Inventors: Kazuya Inoue, Musashino; Yukio Katano, Kawaguchi, both of Japan

[73] Assignee: Kabushiki-Kaisha K I P, Tokyo, Japan

[21] Appl. No.: 718,208

[22] Filed: Aug. 26, 1976

[30] Foreign Application Priority Data

Sept. 8, 1975 Japan ..... 50-108098

[51] Int. Cl.[2] ..... G03G 15/00

[52] U.S. Cl. ..... 355/14; 250/233

[58] Field of Search ..... 355/3, 14; 250/233, 250/570, 573

[56] References Cited

U.S. PATENT DOCUMENTS

| | | | |
|---|---|---|---|
| 3,307,041 | 2/1967 | Kling | 250/233 X |
| 3,510,659 | 5/1970 | Trehn | 250/233 X |
| 3,659,109 | 4/1972 | Hickey et al. | 355/14 X |
| 3,734,608 | 5/1973 | Hickey et al. | 355/14 |
| 3,746,443 | 7/1973 | Hickey | 355/14 |
| 3,907,424 | 9/1975 | Komori et al. | 355/14 X |
| 3,912,390 | 10/1975 | Van Herten | 355/14 |
| 3,914,047 | 10/1975 | Hunt, Jr. et al. | 355/14 X |
| 3,948,586 | 4/1976 | Komori et al. | 355/14 |

*Primary Examiner*—William M. Shoop

*Attorney, Agent, or Firm*—Cushman, Darby & Cushman

[57] ABSTRACT

An apparatus of generating control signals for an electrophotographic copying machine which is provided with a disk fixed to a rotary shaft of a photosensitive drum and having through-holes formed therein, a light emitting device arranged to be opposed to a photosensitive device through the disk to form binary coded light signals and a decoder connected to the photosensitive device to decode the light signals therefrom. As the disk rotates together with the photosensitive drum, the photosensitive device sequentially senses a plurality of binary coded light signals to operate desired devices of the electrophotographic copying machine.

6 Claims, 3 Drawing Figures

Fig. 2
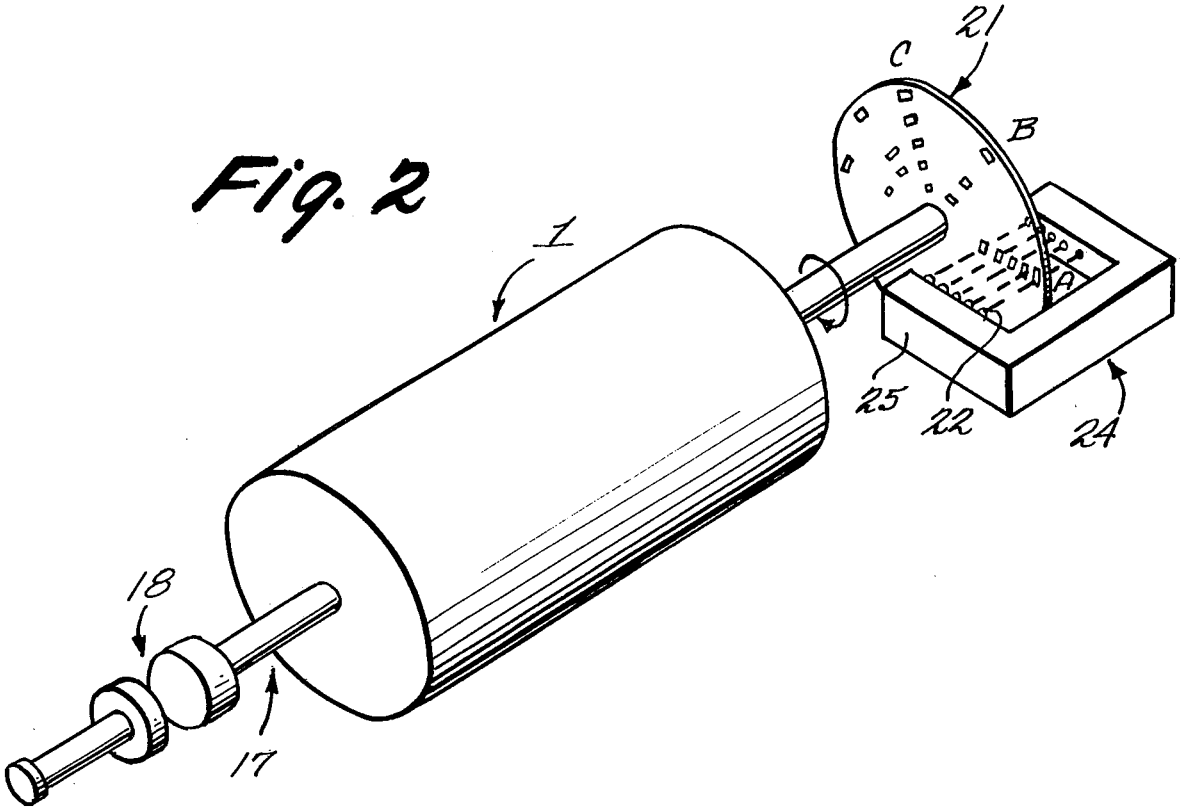
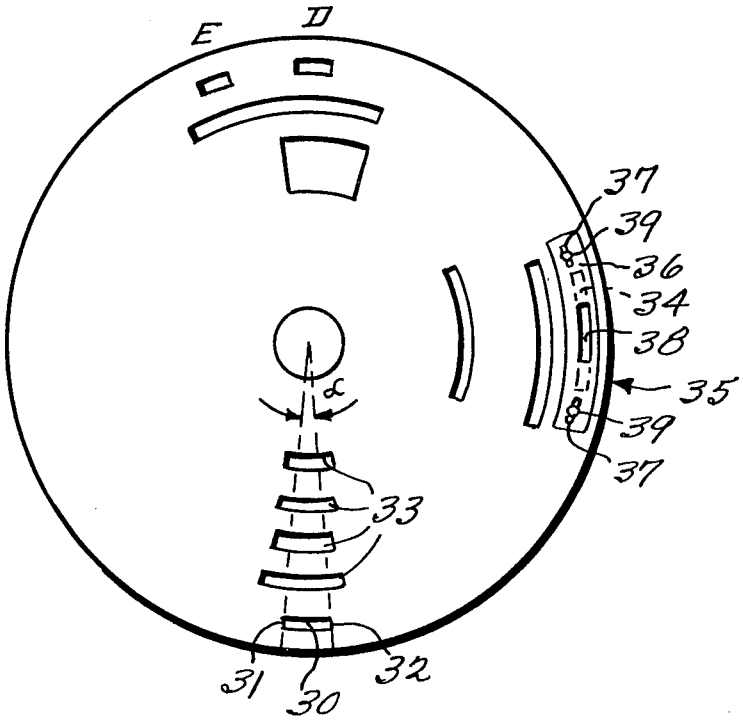
Fig. 3

APPARATUS OF GENERATING CONTROL SIGNALS FOR CONTROLLING AN OPERATION OF AN ELECTROPHOTOGRAPHIC COPYING MACHINE

BACKGROUND OF THE INVENTION

1. Field of the Invention

The present invention relates to an apparatus of generating control signals for sequentially operating various devices incorporated in an electrophotographic copying machine in accordance with angular movement of a photosensitive drum rotatably supported therein.

2. Description of the Prior Art

In general, an electrophotographic copying machine is constructed, for example, as shown in FIG. 1. A photosensitive drum 1 is supported in the copying machine for rotation in an clockwise direction as seen in FIG. 1. Provided on an outer periphery of the drum 1 is a photosensitive layer which is uniformly charged by a corona discharge device 2 and is then exposed to a light image of an original 3 on a movable original carrier 4 by a light-image exposure device 5 thereby forming an electrostatic latent image corresponding to the light image on the photosensitive drum 1. The latent image is then changed into a toner image by a suitable developing device 6. On the other hand, a copy paper 7 is trimmed by a cutter 8 into a desired size and fed by feeding mechanisms 9 and 10 to be brought into contact with the photosensitive drum 1 bearing the toner image thereon. After the toner image has been transferred onto the copy paper 7 under the action of a transferring corona discharge device 11, the copy paper 7 is peeled off by a peeling pawl 12 from the photosensitive drum 1 and fed by a feeding mechanism 13 to a fixing device 14 by which the toner image is fused on the copy paper 7 to form a permanent copy image thereon. The copy paper 7 is then stacked on a tray 15 mounted on an outer frame of the copying machine. The toner remaining on the photosensitive drum 1 after the completion of the transfer of the toner image is removed by a cleaning device 16 to allow the photosensitive drum 1 for repeated use.

Since the electrophotographic copying machine has a number of processing devices as described above, it is a problem how to generate control signals for actuating those devices with preciseness and reliability.

As a prior art for generating such control signals in timed relationship with the angular movement of the photosensitive drum in the well-known electrophotographic copying machine, there is Japanese Laid-Open Patent Application No. 14345/1975 in which a plurality of cams is secured to a shaft of the photosensitive drum and micro-switches are provided in association with the cams for generating signals to control the starting of charging, the turning-on of an exposure lamp, the feeding of the copy paper, and so on. However, since this technical approach requires the plurality of cams and the corresponding number of micro-switches, there are many defects that a large space is occupied by the cams and the micro-switches in the copying machine, that precise adjustment and hence long time are required to mount the cams and the micro-switches in the copying machine in order to operate them in a desired manner, that the response time of the micro-switches varies, and that the contacts of the micro-switches may be oxidized by the influence of the corona discharge causing failure of their operation.

SUMMARY OF THE INVENTION

It is an object of the present invention to provide a novel apparatus of generating control signals for operating various devices of an electrophotographic copying machine which has obviated the above defects.

According to the present invention, an apparatus includes a disk fixed to a rotary shaft of a photosensitive drum and having through-holes formed therein, a light emitting device and a photosensitive device arranged to be opposed to the light emitting device through the disk to sense binary coded light signals formed by the light emitting device and the through-holes of the disk and a decoder connected to the photosensitive device. More specifically, the opaque disk fixed to one end of the shaft of the photosensitive drum is concentrically divided into five equi-distant sections, for example. At a given angular position of the disk, the outermost circumferential section (strobe section) and one or more of the remaining four sections (code sections) are perforated for making signal-forming through-holes corresponding to one control signal to be produced. The light sources of the light emitting device are arranged to be opposed to the photo-sensors of the photosensitive device through the five sections of the disk. The photosensitive device is connected to the decoder (binary-to-hexadecimal converter) such that the output of the photo-sensor associated with the outermost section of the disk is supplied to a strobe terminal of the decoder and the outputs of the photo-sensors associated with the four remaining sections are supplied to input terminals of the decoder. Therefore, a decoder output is produced whenever the output of the photo-sensor associated with the outermost section of the disk is a logic "1". With this arrangement, all of the light beams emitted from the light sources of the light emitting device are first projected to the disk and only such light beams as can pass through the through-holes in any of the five sections of the disk are transmitted to the associated photo-sensors of the photosensitive device in order to form binary coded light signals.

In order to produce control signals necessary to operate the copying machine, there are provided through-holes in the outermost section (strobe section) of the disk, the number of through-holes being equal to that of the signals required and the precise location of each of the through-holes being determined in accordance with the angular position of the photosensitive drum at which a desired control signal should be produced. At each of the angular positions in which the through-hole is formed in the outermost section, one or more through-holes are formed in the four remaining sections associated with that outermost section to form a binary code corresponding to the selected number assigned to the through-hole in the outermost section. For example, if one of the strobe through-holes formed in the outermost section is assigned with the decimal number "8", the four-bit binary code corresponding to that number is the binary number "1000". Assuming that the four inner sections of the disk, in the order of from the innermost section towards the outermost section, correspond to $2^0$ digit, $2^1$ digit, $2^2$ digit and $2^3$ digit, respectively, of the four-bit binary code, through-holes are formed in that strobe section and only the $2^3$ digit section of the code sections in this example. With the arrangement, as the disk rotates together with the photosensitive drum, all of the signals formed by the light emitting device and the through-holes of the disk are sequentially received by the photosensitive device and the resulting electric signals are supplied to the decoder. Thus, a desired control of the devices of the electrophotographic copying machine is made.

In this manner, the disk having four code sections can represent $2^4 - 1 = 15$ different signals. The reason for subtracting one from $2^4$ is that the binary code 0000 can not be used because no through-hole is formed in the code sections.

It should be readily understood that the number of the control signals required can be increased by increasing the number of strobe sections and/or code sections of the disk.

BRIEF DESCRIPTION OF THE DRAWINGS

FIG. 2 is a schematic perspective representation of an apparatus of generating control signals for an electrophotographic copying machine according to the present invention; and FIG. 3 shows a structure of a disk used in the apparatus of the present invention.

DESCRIPTION OF THE PREFERRED EMBODIMENT

Figure 1:
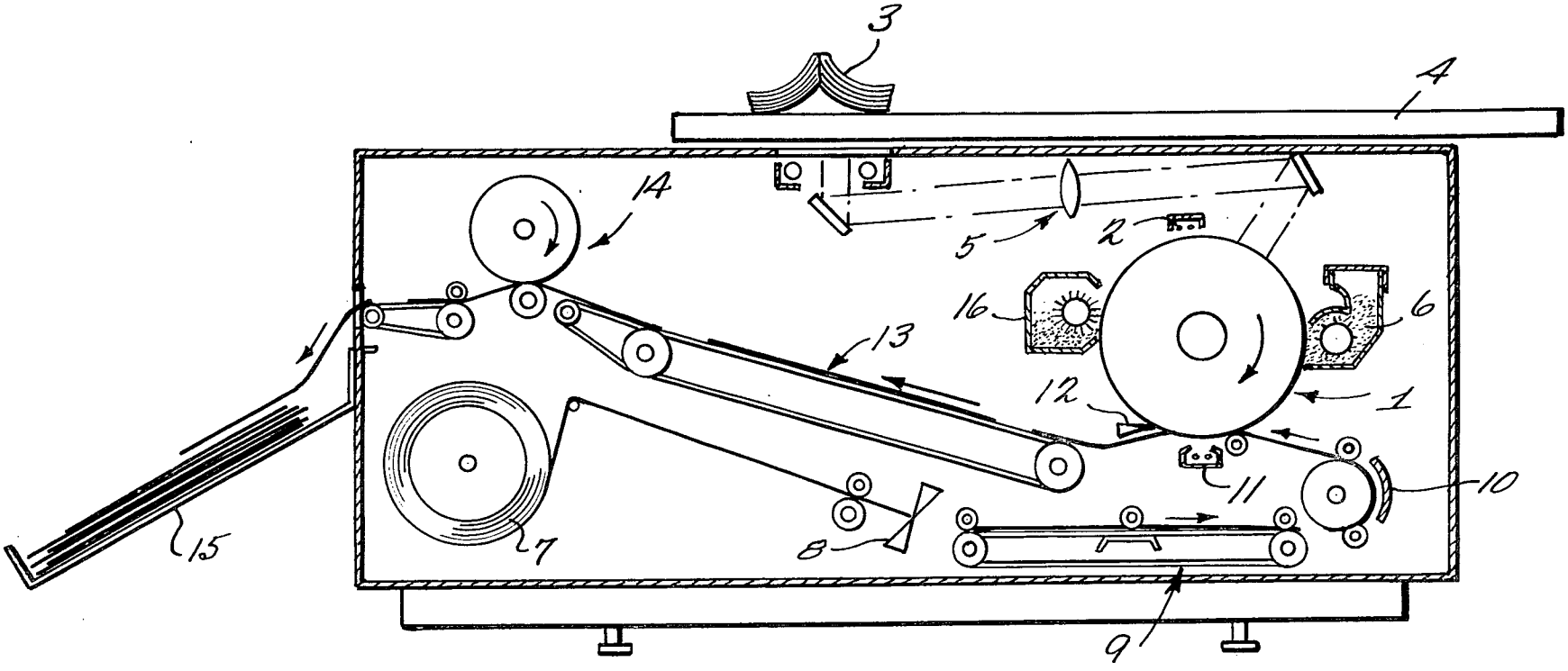
Fig. 1 (PRIOR ART)
FIG. 1 is a schematic side sectional view of a conventional electrophotographic copying machine.

Referring to FIG. 2, a main part of the embodiment of the present invention is shown, in which a disk having through-holes is fixed to one end of a rotary shaft 17 of a photosensitive drum 1 concentrically thereto. The other end of the shaft 17 can be coupled to a driving means (not shown) by a coupling 18 for rotating the photosensitive drum 1 and the disk 21 in a direction of an arrow. The disk 21 is designed to have four-bit information sources or four code sections and one strobe section. A light emitting device 22 and a photosensitive device 23 are mounted on spaced arms 25 and 26, respectively, of a member, and the arms extending in substantially parallel with each other. The support member 24 is fixed to a body of the copying machine. A part of a radial portion of the disk 21 is disposed within the space between the arms 25 and 26, such that the arms 25 and 26 substantially extend across a radius of the disk 21 with they spaced apart from one another. The photosensitive device 23 comprises five phototransisitors as photo-sensors which are provided longitudinally of the arm 26, such that they sense binary coded light signals produced by the light emitting device 22 fixed to the arm 25 and by the through-holes of the disk 21. The photo-transistors associated with the code sections of the disk are connected to input terminals of the decoder and the photo-transistor associated with the strobe section is connected to a strobe terminal of the decoder. The light emitting device 22 comprises five light emitting diodes as light sources which emit lights when a power switch of the copying machine turns on, and which are provided longitudinally of the arm 25 to face the respective photo-transistors of the photosensitive device 23. The number of the photo-transistors of the photosensitive device 23 should be equal to the total number of the sections of the disk 21, but the light emitting device 22 may comprise a single rod-shaped light source substantially extending over the radius of the disk 21. In the copying machine in which developing powder is used, the powder may deposit on the sensing surfaces of the photosensitive device to cause them to malfunction. In such a case, it will be preferable to use a light emitting device which iradiates infrared rays and a photosensitive device which is sensitive to that rays. As shown in FIG. 2, at a reference angular position A of the disk 21, the four code sections and the strobe section are each formed with a through-hole. Thus, all of the photo-transistors in the photosensitive device 23 sense the lights emitted from the light emitting device 22 through the respective through-holes. The signals thus produced are transmitted to the decoder to produce an output pulse at an output terminal No. 15 of the decoder. At a position B of the disk, that is a position delayed by the angles of 90° from the reference position A, through-holes are formed in the $2^0$ digit section and $2^1$ digit section and the strobe section, and at a position C, that is at a position delayed by the angles of 45° from the position B, through-holes are formed in the $2^0$, $2^2$ and $2^3$ digit sections and the strobe section. When the light from the light emitting device 22 is projected to the positions B or C as the disk 21 rotates, output pulses are produced at output terminals No. 3 and No. 13 of the decoder, respectively. Thus, by arranging signal generating sources or perforations corresponding to signals for starting the movement of the original carrier of the copying machine, for feeding the copy paper, for operating the developing device, for operating the cleaning device, etc., at intended positions on the disk 21, those signals are sequentially produced and transmitted to the decoder as the disk 21 and the photosensitive drum 1 rotate.

In FIG. 3, reference numeral 30 designates the through-hole formed in the strobe section and which indicates that code through-holes for generating a certain signal are formed at that position of the disk 21. The arcuate lengths of the through-holes 33 formed in code sections at that position are same or larger than the length of the strobe through-hole in relation with arcuate length defined by an angle $\alpha$ which is confined by two radial lines lying on edges 31 and 32 of the through-hole 30 formed in the strobe section. The photo-sensors associated with the code sections and the photo-sensor associated with the strobe section are connected to the input terminals and the strobe terminal of the decoder, respectively, so that a pulse is produced at the output terminal of the decoder only when the signal from the strobe section and the signals from the code sections are simultaneously transmitted to the decoder. Since the through-hole 30 formed in the strobe section is a reference hole for the signal to be generated at that position, it must be precisely positioned.

The disk 21 is provided at its strobe hole 34 with an adjusting device 35. Where such as adjusting device is used, the arcuate length of the strobe hole 34 is designed to be a little longer than its intended length and the arcuate lengths of the associating through-holes in the code sections are also designed to be longer than the length of the strobe through-hole. The adjusting device 35 includes a slidable control plate 36 for adjusting an effective range of the opening of the strobe hole 34. The control plate 36 has a pair of slots 37 formed therein and it is fixed to the disk 21 by screwing bolts 39 extending through the slots 37 into the disk 21. An aperture 38 is brought into registration with the strobe hole 34 and is designed to be shorter than the arcuate length of the strobe hole 34. With this arrangement of the adjusting device 35, when it is desired to produce a desired signal a little later for the convenience of the operation, it is sufficient to merely displace the control plate 36 by the amount corresponding to the desired delay time. Therefore, the timing of the signal generation required for the operation of the copying machine can be adjusted by a very simple and easy operation.

As shown in FIG. 3, when the through-holes are to be formed in the code section corresponding to the $2^4$ digit at both the position D of the disk 21 and the next signal position E, a through-hole extending from the position D to the position E may be formed. Similarly, when the through-holes are to be formed at the position D in both code sections corresponding to $2^2$ digit and $2^3$ digit, a through-hole extending from the $2^2$ code section to the $2^3$ digit section may be formed.

As described hereinabove, the present apparatus comprises the disk fixed to the shaft of the photosensitive drum and having through-holes formed therein for generating signals, the light emitting device and the photosensitive device arranged on opposite sides of the disk, and the decoder connected to the photosensitive device, and it can sequentially produces a number of binary coded signals required for the copying operation as the photosensitive drum rotates. Thus, according to the present invention, the disk is provided with a strobe through-hole and one or more code through-holes required for generating one signal. Since the only requirement is to form the through-holes in the strobe section, i.e. the outermost circumferential region of the disk precisely, it is possible to precisely determine the timing of the signal generation. In the prior art system, a troublesome procedure such as an exchange of a cam or repositioning of a micro-switch fixed to the body of the copying machine must be necessary to adjust the timing of signal generation. On the other hand, in the present invention, since the signal timing adjusting device is provided on the disk per se, the signal timing can be easily adjusted without damaging the body of the copying machine.

What is claimed is:

1. An apparatus of generating control signals for controling an operation of an electrophotographic copying machine of the type wherein said control signals are generated in timed relationship with rotation of a photosensitive drum disposed in said copying machine, the improvement comprising a disk having through-holes therein and driven in association with said photosensitive drum, a light emitting device, a photosensitive device spaced apart from said light emitting device to sense binary coded light signals formed by said light emitting device and said through-holes of said disk and a decoder connected to said photosensitive device, said disk having a strobe section for strobe through-holes and a plurality of code sections for code through-holes associated with said strobe through-holes, said strobe section and said code sections being formed in outer and inner radial portions, respectively, of said disk, and the arrangement being such that as said disk rotates said strobe and code through-holes are, in operation, brought into registration with the path of light from said light emitting device to said photosensitive device to permit light to pass through said through-holes.

2. An apparatus according to claim 1 in which said light emitting device comprises a single light emitting source substantially extending to face a radius of said disk.

3. An apparatus according to claim 1 in which said light emitting device irradiates infrared rays and said photosensitive device is sensitive to that rays.

4. An apparatus according to claim 1 in which the angle defined by radial lines by lying on opposite ends, respectively, of said strobe through-hole is smaller than the angle defined by radial lines lying on opposite ends, respectively, of said code through-holes.

5. An apparatus according to claim 1 in which said disk is provided with an adjusting device for adjusting an effective opening area of the strobe through-hole.

6. An apparatus according to claim 5 in which said adjusting device includes a control plate adjustably fixed to said disk and having an aperture brought into registration with said strobe through-hole, and the arcuate length of said aperture is shaped to define the opening area of said strobe through-hole to an intended dimension.

* * * * *